US006502935B1

(12) United States Patent
Barcock et al.

(10) Patent No.: US 6,502,935 B1
(45) Date of Patent: Jan. 7, 2003

(54) INK-JET RECORDING MATERIAL COMPRISING PIGMENT LAYERS

(75) Inventors: Richard Barcock, Aylesbury (GB); Alastair Dodds, Harlow (GB); Kirsten Werner, Maidenhead (GB); Dieter Becker, Maidenhead (GB)

(73) Assignee: Felix Schoeller jr. Foto-und Spezialpapiere GmbH & Co. KG (DE)

( * ) Notice: Subject to any disclaimer, the term of this patent is extended or adjusted under 35 U.S.C. 154(b) by 0 days.

(21) Appl. No.: 09/561,396

(22) Filed: Apr. 28, 2000

(30) Foreign Application Priority Data

Apr. 30, 1999 (EP) ..... 99108448

(51) Int. Cl.[7] ..... B41J 2/01
(52) U.S. Cl. ..... 347/105; 428/195
(58) Field of Search ..... 347/105, 101; 428/195, 323, 329, 328

(56) References Cited

U.S. PATENT DOCUMENTS 5,472,757 A * 12/1995 Ogawa et al. ..... 347/105
5,759,673 A * 6/1998 Ikezawa et al. ..... 428/195
5,911,855 A * 6/1999 Dransmann et al. ..... 428/195
6,149,995 A * 11/2000 Peiffer et al. ..... 428/323
6,177,188 B1 * 1/2001 Ichioka et al. ..... 347/105

FOREIGN PATENT DOCUMENTS

EP 0 806 299 4/1997

* cited by examiner

*Primary Examiner*—John Barlow
*Assistant Examiner*—Manish S. Shah
(74) *Attorney, Agent, or Firm*—Cook, Alex, McFarron, Manzo, Cummings & Mehler, Ltd.

(57) ABSTRACT

Ink-jet recording material having a support material and pigment layers provided on the support material, and wherein the pigment layers comprise at least a lower layer containing barium sulphate and upper layer containing an aluminum oxide.

34 Claims, No Drawings

INK-JET RECORDING MATERIAL COMPRISING PIGMENT LAYERS

BACKGROUND, SUMMARY AND DESCRIPTION OF THE INVENTION

BACKGROUND of the INVENTION

The invention relates to a recording material for the ink-jet printing process.

The technology for producing color printouts has, in recent years, much increased in significance in conjunction with the overall expansion of the electronic media. The goal of this technology is the adaptation of the image quality of color printouts to the level of silver salt photography.

One important technology is the ink-jet printing method which has provided improved image quality in the last years. In the ink-jet printing method fine ink droplets are applied to a recording material. High demands are made of the ink-jet recording materials used in this technology. Such requirements are, for example, high resolution, high color density, no bleed, short drying time of the ink, light fastness as well as dimension stability. A further important requirement for commercial applications is the surface gloss. This is in particular important for the preparation of art graphics, but also for the creation of images which provide a photographic look.

EP 0 650 850 discloses a recording material which consists of a polyolefin coated base paper and a recording layer. This material allows the preparation of images with high resolution, color density and high gloss, which are comparable to common photographic images as far as their appearance is concerned. One disadvantage of this resin coated paper is the inferior ink absorption capacity which is due to the sealing action of the resin resulting in inferior drying properties of the recording material, which gives rise to ink bleed and poor overall image quality.

JP 10-119424 proposes a recording paper that comprises a hydrophobic support and two porous silica containing layers. The particle size of the silica in the upper layer is smaller than the particle size of the silica particles in the lower layer. A disadvantage of this recording material is the long drying time.

Glossy recording materials are known which are obtained by cast-coating the recording layer onto a support and treatment of the resulting product with an extremely smooth heated cylinder surface, whereby a recording material with a high glossy surface is achieved.

EP 0 450 540 B1 discloses an ink-jet recording material with a lower pigment layer on a support material and an upper pigment layer formed on the lower pigment layer. White aluminum oxide is the major pigment in both layers, aluminum oxide in the lower layer has a smaller specific surface area (<90m$^2$/g) than $Al_2O_3$ in the upper layer (90–170m$^2$/g) . This recording material is described to provide a high color density and images with very slight indoor color changes.

SUMMARY of the INVENTION

The problem of the present invention is to provide a recording material for the ink-jet printing method with a high ink absorption capacity, a short drying time and good smear resistance properties. Moreover, this recording material shall allow the creation of images with high color density and gloss.

This problem is solved with a recording material that comprises a support material and pigment layers provided on the support material, wherein said pigment layers comprise a lower layer containing barium sulfate and an upper layer containing aluminum oxide as a main pigment. This problem is further solved by a recording material that comprises a support material and pigment layers provided on the support material, wherein said pigment layers comprise a lower layer containing barium sulfate and an upper layer containing a mixture of at least two pigments.

DETAILED DESCRIPTION of the INVENTION

The lower layer may contain besides barium sulfate as a major pigment, at least one further pigment. Particularly suited as a further pigment is aluminum oxide, silica and/or barium oxide. The aluminum oxide used in the invention is a so called active aluminum oxide which, for example, is obtained by calcination of aluminum hydroxide and which may have a specific surface area (BET) of 160 to 240 m$^2$/g and an average particle size of 0.7 to 5 $\mu$m, preferably 1 to 3 $\mu$m. The silica which may be used according to the invention is preferably those which are obtained by precipitation and which may have a specific surface area (BET) of 30 to 800 m$^2$/g. The silica obtained by precipitation may have an average particle size of 0.7 to 5 $\mu$m, preferably 3 to 5 $\mu$m.

The particle size of the barium sulfate which is used according to the invention may be 0.2 to 2.0 $\mu$m, preferably 0.7 to 1.2 $\mu$m. The mass ratio barium sulfate/aluminum oxide amounts to 4:1 to 1:1.

The use of an aluminum oxide or a silica in the lower layer improves the absorption capacity of this baryta containing layer. Accordingly, the applied coating weight of the upper layer may be reduced without impairing the absorption capacity of the recording material. With a reduction in the coating weight of the upper layer it is possible to eliminate the so-called "cracking-effect" which can occur during drying of the layer, especially at higher coat weights, and which impairs the image quality. Moreover, the modification of the baryta containing layer eliminates dusting problems and improves the adhesion to the support. In order to achieve these aims it is not required that the specific surfaces of the pigments used in the upper and the lower layer are different as, for example, disclosed in EP 0 450 540 B1.

The binder used in the lower layer may be selected from the group of hydrophilic colloidal and/or water soluble binding agents such as polyvinyl alcohol, polyvinyl pyrrolidone, polyvinyl acetate, gelatin, starch, starch derivatives, casein, cellulosic esters, alginates, polyethylene glycols, polyacrylic acid or mixtures thereof. In particular suited as a binder in the lower layer is gelatin. Each kind of gelatin may be used. Preferably, a gelatin with a gel strength of 100 to 300 bloom, in particular 100 to 200 bloom (determined according to BIS 757, 1975) is used.

The mass ratio pigment to binder in the lower layer amounts from 1:1 to 10:1, in particular 1:1 to 8:1.

Further additives may be used in the lower layer such as crosslinking agents, dispersing agents, plasticizers and optical brighteners. The coating weight of the lower layer may be 5 to 30 g/m$^2$, preferably 10 to 25 g/m$^2$.

The pigment mixture of the upper layer consists of at least two finely divided pigments, the particle size of which shall not be larger than 500 nm. Particularly preferred is a mixture of aluminum oxide with a particle size of 50 to 150 nm and silica with a particle size of 200 to 300 nm. According to a particular preferred embodiment of the invention a mixture of a cationically modified aluminum oxide and a cationically modified silica is used. The mass ratio of aluminum oxide to silica may amount from 4:1 to 1:1.

According to the further embodiment of the invention the upper layer comprises barium sulfate and/or barium oxide in an amount of up to 50% by weight, relating to the dried layer.

The binder used in the upper layer may be selected from the group of hydrophilic colloidal and/or water soluble binding agents such as polyvinyl alcohol, polyvinyl pyrrolidone, polyvinyl acetate, gelatin, starch, starch derivatives, casein, cellulosic esters, alginates, polyethylene glycols, polyacrylic acid or mixtures thereof. Particularly suited as a binding agent in the upper layer is polyvinyl alcohol, whereby a completely saponified polyvinyl alcohol with a high viscosity of 35 to 80 cP, in particular 50 to 75 cP, determined in aqueous solutions of a concentration of 4% by weight at 20° C. is particularly preferred. Also partially saponified polyvinyl alcohols or cationically modified polyvinyl alcohols may be used according to the invention.

The mass ratio pigment/binder in the upper layer amounts to 20:1 to 1:1, preferably 14:1 to 6:1 and more preferably 8:1 to 6:1.

The upper layer may contain further additives such as dye fixing agents, crosslinking agents, coloring pigments and optical brighteners. Examples of dye fixing agents are quaternary polyammonium salts, cationic polyamines, cationic polyacryl amides and cationic polyethylene imines. The amount of the additive can be up to 5% by weight, based on the dry layer. The coating weight of the upper layer amounts to 10 to 25 g/m$^2$, preferably 15 to 20 g/m$^2$.

Further layers may be provided between lower and upper layers.

As a support material any kind of raw base paper may be used. Preferably surface sized papers, calendered or non-calendered papers or highly sized raw base papers may be used. The raw base paper may be sized with acidic or neutral sizing agents. Especially suitable are papers with a surface roughness of less than 300 Sheffield units determined according to Tappi T538 roughness. The raw base paper shall have a high dimensional stability and should be able to absorb the water, which is contained in the ink without formation of curl. Papers with a high dimensional stability which are manufactured from pulp mixtures, comprising softwood sulphate fiber pulp and eucalyptus pulp are particularly suited. The disclosure of DE 196 02 793 B1, which discloses a raw base paper for an ink-jet recording material, is incorporated herein by reference.

According to a particular preferred embodiment of the invention the raw base paper is sized not too strongly in order to allow a paper surface with an open pore structure. Particularly preferred papers are those having a roughness of less than 200 Sheffield units. The basis weight of the raw base paper generally may be 50 to 300 g/m$^2$. According to a further preferred embodiment the support material is resin coated on its back side. As resins polyolefins or polyesters may be used. The polyolefin used for coating of the base paper is preferably a polyethylene of low density (LDPE) and/or polyethylene of high density (HDPE). The coating weight of the resin layer which additionally may contain pigments and other additives, amounts to at least 5 g/m$^2$ and more preferably up to 20 g/m$^2$.

For application of the layers according to the invention onto the support material any conventional coating and metering process may be used, such as roller coating, engravure or nip processes, air brushing or bleed knife metering.

After the application of the layers, and after the layers are dried, the coated paper may be calendered in order to further increase the smoothens.

The following examples further explain the invention.

EXAMPLE 1

To the front side of a raw paper having a basis weight of 135 g/m$^2$, sized with alkylene dimer sizing agent and surface-sized with starch, the first baryta containing coating solution was applied by Meyer Bar in an amount giving a dried coating weight of 15 g/m$^2$ followed by drying at 100° C. to form a lower layer 1A. On this lower layer, the second coating solution was applied using a slot-die at 50 m/min in an amount giving a dried coating weight of 20 g/m$^2$ followed by drying at 100° C. to form an upper layer 1B. The composition of the lower and upper layer is shown in Tables 1 and 2.

EXAMPLES 2–9

These Examples were carried out according to Example 1 except that the paper base was provided with the following layers:

| Example | Lower layer/Coating weight | | Upper layer/Coating weight | |
|---|---|---|---|---|
| 2 | 2A | 15 g/m$^2$ | 1B | 15 g/m$^2$ |
| 3 | 3A | 14 g/m$^2$ | 1B | 20 g/m$^2$ |
| 4 | 3A | 15 g/m$^2$ | 5B | 20 g/m$^2$ |
| 5 | 2A | 15 g/m$^2$ | 3B | 20 g/m$^2$ |
| 6 | 2A | 15 g/m$^2$ | 4B | 20 g/m$^2$ |
| 7 | 4A | 20 g/m$^2$ | 1B | 15 g/m$^2$ |
| 8 | 4A | 14 g/m$^2$ | 2B | 15 g/m$^2$ |
| 9 | 5A | 15 g/m$^2$ | 1B | 20 g/m$^2$ |

EXAMPLE 10

A recording material was prepared in the same manner as in Example 3 except that the raw base paper was coated on the back side with a clear polyethylene in an amount of 20 g/m$^2$. The polyethylene was a low density polyethylene (LDPE) with a density d=0.923 g/m$^3$ and MFI=4.4. The compositions of the lower and upper layers are shown in tables 1 and 2.

TABLE 1

| | Amount, wt. %* | | | | |
|---|---|---|---|---|---|
| Lower layer/composition | 1A | 2A | 3A | 4A | 5A |
| Barium sulphate, av. particle size: 0.7–1.20 $\mu$m | 72.0 | 45.0 | 69.2 | 43.3 | 69.2 |
| Aluminum oxide, av. particle size: 1.45 $\mu$m, specif. surface: 123.8 m$^2$/g (Martoxin ® GL-1) | 18.0 | 45.0 | 17.3 | 43.2 | — |
| Silica, av. particle size: 3–5 $\mu$m (Gasil ® HP 35) | — | — | — | — | 17.3 |
| Gelatin, 140 ± 20 Bloom | 9.7 | 9.7 | 13.2 | 13.2 | 13.2 |
| Chromalaun | 0.2 | 0.2 | 0.2 | 0.2 | 0.2 |
| TAF/Formaldehyde | 0.1 | 0.1 | 0.1 | 0.1 | 0.1 |

*All amounts are related to the dry layer

TABLE 2

| Upper layer/composition | Amount, wt. %* | | | | |
|---|---|---|---|---|---|
| | 1B | 2B | 3B | 4B | 5B |
| Aluminum oxide, av. particle size: 130–140 nm, specif. surface: 50–60 $m^2/g$, (Cabot ® 003) | 62.14 | 44.37 | 71.73 | 80.15 | 82.83 |
| Silica, av. particle size: 300 nm, | 26.60 | 44.37 | 7.97 | 8.59 | 10.35 |
| Polyvinyl alcohol, saponf. value: 98 mol %, viscosity: 62–72 cP (4% aq. sol. at 20° C.), (Airvol ® 350) | 11.10 | 11.10 | 20.00 | 11.10 | 6.70 |
| Boric acid | 0.16 | 0.16 | 0.30 | 0.16 | 0.12 |

*All amounts are related to the dry layer

Comparative Example C1

To the same support as used in Example 1, the standard baryta solution was applied for forming the lower layer with the dry coating weight of 20 $g/m^2$. Then the lower layer was provided with the upper layer 1B in an amount of 30 $g/m^2$.

Comparative Example C2

The same support as used in Example 1 was provided with the lower layer 3A in an amount of 15 $g/m^2$ and with the upper layer (20 $g/m^2$) with the following composition:

| Upper layer/Comparative Example C2 | |
|---|---|
| Silica, av. particle size: 300 nm, specif. surface: 23.6 $m^2/g$ | 88.74 wt. %* |
| Polyvinyl alcohol, saponif. value: 98 mol % (Airvol ® 350) | 11.10 wt. % |
| Boric acid | 0.16 wt. % |

*All amounts are related to the dry layer

Comparative Example C3

The same support as used in Example 1 was provided with the following lower layer in an amount of 15 $g/m^2$ and with the upper layer 1B in an amount of 20 $g/m^2$.

| Lower layer/Comparative Example C3 | |
|---|---|
| Barium sulphate, av. particle size: 0.7–1.2 $\mu$m | 69.1 wt. %* |
| Calcium carbonate, av. particle size: 10 $\mu$m | 17.30 wt. % |
| Gelatin, 140 ± 20 Bloom | 13.30 wt. % |
| Chromalaun | 0.20 wt. % |
| TAF/Formaldehyde | 0.10 wt. % |

*All amounts are related to the dry layer

Testing of the Recording Material Obtained According to Example 1–10 and Comparison Examples C1–C3

The recording material was printed with an ink jet color printer Epson 740, and the corresponding inks at 720 DPI (dots per inch).

The printed images were tested for color density, drying time, bleed and smear resistance.

The gloss was measured on the unprinted material with a three angle gloss measuring device manufactured by Dr. Lange, at 60° measurement angle.

Color density was measured with an X-Rite densitometer Type 428 for the colors cyan, magenta, yellow and black.

The running together of the inks at the margins of adjacent areas of color (bleed) was evaluated visually with the grades 1–5 (excellent to poor) The smear resistance was tested by rubbing the printed image with a white cloth. This test was carried out individually for each color and was evaluated visually with the grades 1–5 ("1"—no color residues detectable on the cloth, "5"—strong visible color residues detectable)

The drying behavior of the printing material was determined as follows:

An A5 image is printed. As soon as the printer has finished printing, the print is removed and is attempted to be smudged by lightly rubbing a finger over the image. If no obvious smear of image is seen, the dry time is classified as being <10 s. Test results:

| | Color Density | | | | Drying | Bleed | Smear | |
|---|---|---|---|---|---|---|---|---|
| | cyan | magenta | yellow | black | property | (note) | resist. | Gloss |
| 1 | 2.78 | 1.83 | 1.57 | 2.76 | <10 s | 2 | 1 | 32 |
| 2 | 2.79 | 1.81 | 1.55 | 2.77 | <10 s | 1.5 | 1 | 33 |
| 3 | 2.70 | 1.74 | 1.47 | 2.66 | <10 s | 1.5 | 1 | 31 |
| 4 | 2.80 | 1.88 | 1.66 | 2.82 | <10 s | 1 | 1 | 38 |
| 5 | 2.79 | 1.87 | 1.65 | 2.80 | <10 s | 1 | 1 | 36 |
| 6 | 2.84 | 1.92 | 1.69 | 2.85 | <10 s | 1 | 1 | 38 |
| 7 | 2.79 | 1.82 | 1.56 | 2.75 | <10 s | 1 | 1 | 32 |
| 8 | 2.71 | 1.77 | 1.52 | 2.65 | <10 s | 1 | 1 | 20 |
| 9 | 2.76 | 1.81 | 1.59 | 2.76 | <10 s | 1 | 1 | 30 |
| 10 | 2.65 | 1.82 | 1.68 | 2.66 | <10 s | 1 | 1 | 31 |
| C 1 | 2.53 | 1.71 | 1.45 | 2.47 | <30 s | 3 | 2 | 24 |
| C 2 | 2.05 | 1.33 | 1.27 | 2.05 | <10 s | 1 | 1 | 5 |
| C 3 | 2.53 | 1.65 | 1.31 | 2.34 | <20 s | 2 | 2 | 12 |

We claim:

1. An ink-jet recording material comprising a support material and pigment layers provided on the support material, wherein said pigment layers comprise at least a lower layer containing barium sulphate and at least one further pigment having a particle size of from 0.7 to 5 $\mu$m, and an upper layer containing an aluminum oxide as a main pigment.

2. An ink-jet recording material according to claim 1, wherein the further pigment is an aluminum oxide, a silica or barium oxide.

3. An ink-jet recording material according to claim 1, wherein the lower layer contains gelatin as binding agent.

4. An ink-jet recording material according to claim 1, wherein the barium sulphate contained in the lower layer is in an amount of 50 to 80% by the weight of all pigments contained in said layer.

5. An ink-jet recording material according to claim 1, wherein the ratio pigment to binder in the lower layer is in the range of 8:1 to 1:1.

6. An ink-jet recording material according to claim 1, wherein the upper layer contains a mixture of an aluminum oxide and a silica.

7. An ink-jet recording material according to claim 6, wherein the aluminum oxide contained in the mixture has an average particle size of 50 to 150 nm.

8. An ink-jet recording material according to claim 6, wherein the silica pigment contained in the mixture has an average particle size of 200 to 300 nm.

9. An ink-jet recording material according to claim 1, wherein the upper layer contains barium sulphate and/or barium oxide.

10. An ink-jet recording material according to claim 1, wherein the amount of the aluminum oxide in the upper layer is in the range from 50 to 80% by the weight of all pigments contained in the upper layer.

11. An ink-jet recording material according to claim 1, wherein the upper layer contains polyvinyl alcohol as a binding agent.

12. An ink-jet recording material according to claim 1, wherein the ratio of pigment to binder in the upper layer is in the range of 14:1 to 6:1.

13. An ink-jet recording material according to claim 1, wherein the support material is a coated or uncoated paper.

14. An ink-jet recording material according to claim 1, wherein the support material is a base paper coated on the back side with a polyethylene.

15. An ink-jet recording material comprising a support material and pigment layers provided on the support material, wherein said pigment layers comprise at least a lower layer containing barium sulphate and at least one further pigment having a particle size of from 0.7 to 5 $\mu$m, and an upper layer containing a mixture of at least two pigments.

16. An ink-jet recording material according to claim 15, wherein the further pigment is an aluminum oxide, a silica or barium oxide.

17. An ink-jet recording material according to claim 15, wherein the lower layer contains gelatin as binding agent.

18. An ink-jet recording material according to claim 15, wherein the barium sulphate contained in the lower layer is in an amount of 50 to 80% by the weight of all pigments contained in said layer.

19. An ink-jet recording material according to claim 15, wherein the ratio of pigment to binder in the lower layer is in the range of 8:1 to 1:1.

20. An ink-jet recording material according to claim 15, wherein the upper layer contains a mixture of an aluminum oxide and a silica.

21. An ink-jet recording material according to claim 20, wherein the aluminum oxide contained in the mixture has an average particle size of 50 to 150 nm.

22. An ink-jet recording material according to claim 20, wherein the silica pigment contained in the mixture has an average particle size of 200 to 300 nm.

23. An ink-jet recording material according to claim 15, wherein the upper layer contains barium sulphate and/or barium oxide.

24. An ink-jet recording material according to claim 15, wherein the amount of the aluminum oxide in the upper layer is in the range from 50 to 80% by the weight of all pigments contained in the upper layer.

25. An ink-jet recording material according to claim 15, wherein the upper layer contains polyvinyl alcohol as a binding agent.

26. An ink-jet recording material according to claim 15, wherein the ratio of pigment to binder in the upper layer is in the range of 14:1 to 6:1.

27. An ink-jet recording material according to claim 15, wherein the support material is a coated or uncoated paper.

28. An ink-jet recording material according to claim 15, wherein the support material is a base paper coated on the back side with a polyethylene.

29. An ink-jet recording material according to claim 1, wherein the barium sulphate is 0.2 to 2.0 $\mu$m.

30. An ink-jet recording material according to claim 29, wherein the barium sulphate is 0.7 to 1.2 $\mu$m.

31. An ink-jet recording material according to claim 15, wherein the barium sulphate is 0.2 to 2.0 $\mu$m.

32. An ink-jet recording material according to claim 31, wherein the barium sulphate is 0.7 to 1.2 $\mu$m.

33. The ink-jet recording material according to claim 1, wherein said pigment layers are of high gloss.

34. The ink-jet recording material according to claim 15, wherein said pigment layers are of high gloss.

* * * * *